United States Patent [19]

Makarenko

[11] Patent Number: 4,749,208

[45] Date of Patent: Jun. 7, 1988

[54] SKI BINDING

[75] Inventor: Vladimir S. Makarenko, Leningrad, U.S.S.R.

[73] Assignee: Leningradsky Politekhnichesky Institut Imeni M.I. Kalinina, Leningrad, U.S.S.R.

[21] Appl. No.: 23,806

[22] PCT Filed: Apr. 18, 1986

[86] PCT No.: PCT/SU86/00032

§ 371 Date: Dec. 12, 1986

§ 102(e) Date: Dec. 12, 1986

[87] PCT Pub. No.: WO86/06289

PCT Pub. Date: Nov. 6, 1986

[30] Foreign Application Priority Data

Apr. 24, 1985 [SU] U.S.S.R. ..... 3878644

[51] Int. Cl.[4] ..... A63C 9/18

[52] U.S. Cl. ..... 280/615

[58] Field of Search ..... 280/611, 614, 615, 626

[56] References Cited

U.S. PATENT DOCUMENTS

| | | | |
|---|---|---|---|
| 4,017,096 | 4/1977 | Pinsonnault | 280/615 |
| 4,102,063 | 7/1978 | Ihlen | 280/615 X |
| 4,322,091 | 3/1982 | Storandt | 280/615 |

FOREIGN PATENT DOCUMENTS

| | | | |
|---|---|---|---|
| 3240750 | 5/1984 | Fed. Rep. of Germany . | |
| 2264572 | 10/1975 | France . | |
| 2582531 | 12/1986 | France | 280/615 |
| 283869 | 1/1971 | U.S.S.R. . | |

*Primary Examiner*—John J. Love
*Assistant Examiner*—Michael Mar
*Attorney, Agent, or Firm*—Burgess, Ryan & Wayne

[57] ABSTRACT

A ski binding comprises rest pins (1) mounted on a ski (2) for fitting in corresponding holes (3) in a toe portion of a sole (4) of a boot (5) and a lock (6) restraining vertical movement of the boot (5). At least one part of the surface of the hole (3), contacting with the surface of the pin (1), is shaped as an arc that essentially corresponds a trajectory of a portion of the sole (4) of the boot (5) adjacent to the pin (1), when the skier pushes.

5 Claims, 2 Drawing Sheets

SKI BINDING

The invention relates to sporting gear, and more specifically, to a ski binding for cross-country skis.

The invention may be effectively used both for sporting cross-country skis and for touring cross-country skis.

Today we witness the dramatic growth and changes of the standards that the sporting gear must meet. As the skating stride is gaining popularity, it has become necessary to enhance the ski boot sole resistance to twisting, because in this way the skier over a long period of time runs on the ski edge. In this case the sliding surface of the ski (and the boot sole surface as well) forms a substantial angle with the surface of the ski-track bringing about strong twisting moments with respect to the boot sole when the skier pushes.

PRIOR ART

At present an "Adidas" ski binding is widely used, that consists of a plate with side-frames set at an angle to the longitudinal axis of the ski. The plate size and the value of the side-frames slope are determined by the size and shape of the boot sole toe. The binding is designed for use with a ski boot that has a flange on the upper surface of the boot sole toe. The binding lock is designed in the following way. The plate carries a pin to which a lever is fixed that has still another pin at its free end. To this latter pin a second lever is fixed, in its turn, the free end thereof holding down the flange of the boot sole toe.

The lock the boot the skier must rest the end of the second lever against the boot flange and press the first lever which in this case keeps turning until the line connecting the two pins becomes lower than the line connecting the first pin with the rest point. In this position the boot gets locked. Disadvantages of said binding include its considerable weight, relatively low adaptability to manufacture, resulting mainly from high complexity of the lock design, considerable torques arising in the horizontal plane, the latter disadvantage being especially serious when the skier uses a skating stride. Strong sole twisting is caused not only by the binding design but also by a narrow sole toe of a "Racing Norm 38" type boot which has a narrower toe as compared to a "Racing Norm 50" type.

Ski bindings of the "Rotafella" type are widely used nowadays. This binding also consists of a plate with side-frames set at an angle to the longitudinal axis of the ski. As distinct from the "Adidas" binding, it has three pins mounted directly on the plate, which mate with the holes in the boot sole toe. The boot is locked with a shackle, free ends of which are set in sleeves of side-frames. In the foremost part of the binding there is an axle carrying a notched plate. The boot is placed in such a way that the holes in the boot sole toe mate with the pins. Then the skier presses the shackle into engagement with one of the notches in the plate. Modifications of the binding may have different types of locks. Secure boot looking and a smaller torque occuring in the plane perpendicular to the ski longitudinal axis as compared to the "Adidas" binding mentioned above may be cited as advantages of said binding. Disadvantages include its considerable weight, relatively low adaptability of the binding and the lock to manufacture and, in particular, the necessity to use hands (poles) when locking and unlocking the boot.

As the boot sole toe portion grows wider it is followed by an increase in the force opposing its bending in the vertical plane, oriented along the longitudinal axis of the ski. Said negative phenomenon is clearly enough manifested when the skier uses a classical stride. Thus, the two ski binding designs cited above illustrate the fact that there exists a contradiction: the better the ski binding is adapted to a classical stride the worse it functions when a skating stride is used. It is evident that with a classical stride the ski binding adapted to the "Racing Norm 38" type boot functions better than with a skating stride as compared to the binding adapted to the "Racing Norm 50" type boot. It is quite the opposite when a skating stride is used.

There is a prior art ski binding which consists of rest pins, of two parts each (cf. FRG Patent Application as published for opposition No. 3240750). One part of the pin is directly fixed in the ski (boot) body and the other part fits in a corresponding hole in the boot (ski). If the bottom part of the pin is fixed in the ski body, then, in order to lock the boot it is necessary to place it so that upper parts of the pins fit in the holes in the boot sole toe. To restrain the boot vertical movement various locks are employed. Advantages of said binding include relatively high adaptability to manufacture and simple design, use of rest pins in combination with various easy-to-manufacture locks. Disadvantages include relatively poor functional qualities of the binding when locking and unlocking the boot because this can be done only manually.

A prior art binding (cf. FRG Patent No. 8425984.1) comprises ski-mounted rest pins for mating with corresponding holes in the boot sole toe and a lock featured as a bracket-shaped blade spring for straddling from above the boot sole toe and having one end attached to the ski. Relatively high adaptability to manufacture, small weight, ease of handling. The latter is due to the fact that the proposed binding design provides for automatic (no need to use hands or a ski pole) locking of the boot.

A disadvantage of said design of the binding is that it can be used only with boots that have a welt or a projecting sole toe. Said ski binding design is characterized by serious stresses occuring in the rest pins area of the sole as all forces are actually taken by the pins which can bring about failure of the pins and the sole.

SUMMARY OF THE INVENTION

The invention is directed to the provision of a ski binding that would make it possible to reduce the bending moment acting on the binding elements when the skier pushes.

The problem is solved by designing a ski binding comprising rest pins mounted on a ski for fitting in corresponding holes in a toe portion of a sole of a boot, and a lock restraining vertical movement of the boot, wherein, according to the invention at least one part of the surface of the hole contacting with the surface of the pin, is shaped as an arc that essentially corresponds to a trajectory of a portion of the sole of the boot adjacent to the pin, when the skier pushes.

The proposed design of the ski binding provides for considerable reduction of the bending moment acting on the rest pins and the sole of the boot in the corresponding holes zone. This, in its turn, makes it possible to augment the ski binding reliability and to prolong its service life. Besides, the binding provides for higher effectiveness of the skier's pushing as the force bending the boot sole is considerably reduced.

According to one embodiment of the invention at least one part of the surface of the pin contacting with the surface of the hole, is shaped as an arc that essentially corresponds to a trajectory of a portion of the sole of the boot adjacent to the pin, when the skier pushes.

According to another embodiment of the invention the hole for accomodating the pin has an expansion directed towards the counter of the boot, the arched part of the surface of the hole being an area of the surface of the hole in the expansion zone, contacting with the pin.

Said embodiment is somwhat more adaptable to manufacture and easier to handle because it permits using standard straight pins.

According to one embodiment of the invention a shock-absorber of elastic material is mounted in the expansion zone of the hole.

Introduction of the shock-absorber provides for a more uniform distribution of the force acting on the pin when the skier pushes.

BRIEF DESCRIPTION OF THE DRAWINGS

Other objects and advantages of the present invention will become clear from the following description of specific embodiments thereof with reference to the accompanying drawings, wherein.

BEST MODE OF CARRYING OUT THE INVENTION

Figure 1:
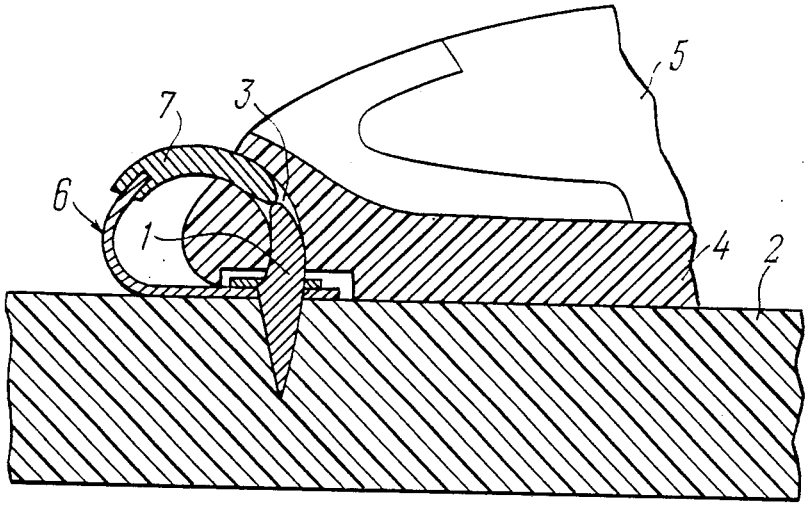
FIG. 1 represents an embodiment of the ski binding, according to the ianvention (longitudinal section)

The proposed ski binding comprises rest pins 1 (FIG. 1) mounted on a ski 2 for fitting in corresponding holes 3 of a sole 4 of a boot 5, and a lock 6. Contacting parts of the surface of each pin 1 and hole 3 are shaped as an arc that essentially corresponds to a trajectory of a portion of the sole 4 of the boot 5 adjacent to the pin 1, when the skier pushes. Each arc-shaped hole is designed as a through hole between the base of the sole 4 and its forward end surface.

The lock 6 of the ski binding is designed as a blade bracket-shaped spring one end thereof being rigidly attached to the ski 2 while its other free end is furnished with a removable fork 7 for insertion into the hole 3 of the sole 4 of the boot 5.

The ski binding operates as follows.

The lock 6 is pressed out in the direction of the toe of the ski 2 and the pins 1 on the ski 2 are aligned with the corresponding holes 3 of the sole 4 of the boot 5. The pins 1 having been inserted into the holes 3, the lock 6 is released.

Then the removable fork 7 with its two ends that match the holes 3 in size is introduced into the holes 3. After that the free end of the fork 7 is fitted on the lock 6, for example, in such a way that the free end of the fork 7 straddles the free end of the lock 6. The fork 7 is made removable for easier locking of the boot 5 on the pins 1. Permanent joining of the lock 6 to the fork 7 would cause difficulty mating the holes 3 of the boot 5 with the arc-shaped pins 1.

When the skier runs the boot 5 fixed on the pins 1 by means of the lock 6 moves with respect to the pins 1 in the vertical plane.

In the course of this movement the arched surface of each hole 3 slides against the arc-shaped pins 1 and the lock 6.

Figure 2:
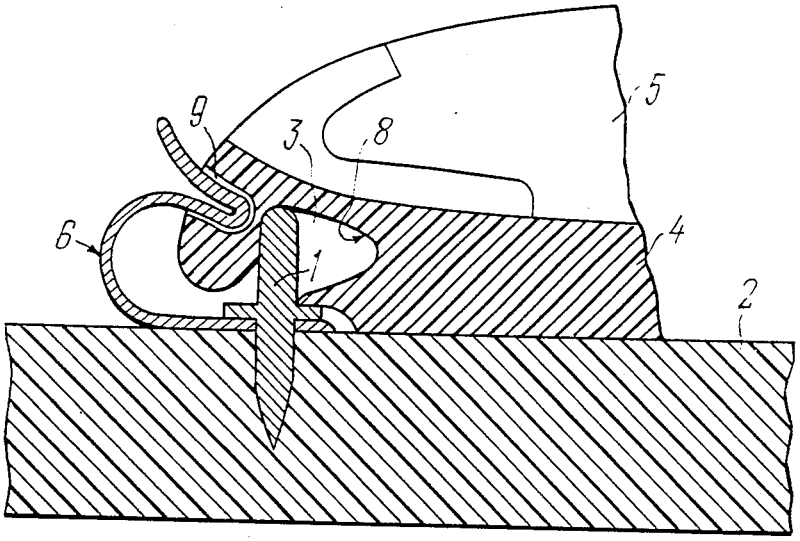
FIG. 2 is an embodiment of the ski binding of FIG. 1 (longitudinal section)

FIG. 2 shows an embodiment of the ski binding wherein regular straight pins are used. Each hole 3 has an expansion directed towards the counter of the boot 5.

An area 8 of the surface of the hole 3 in the expansion zone, that contacts the pin 1, is shaped as an arc that essentially corresponds to a trajectory of a portion of the sole 4 of the boot 5 adjacent to the pin 1, when the skier pushes. The lock 6 in this embodiment is also designed as a blade bracket-shaped spring one end thereof being rigidly attached to the pins 1 while the other free end is introduced into a recess 9 in the face of the toe portion of the sole 4 of the boot 5.

Figure 3:
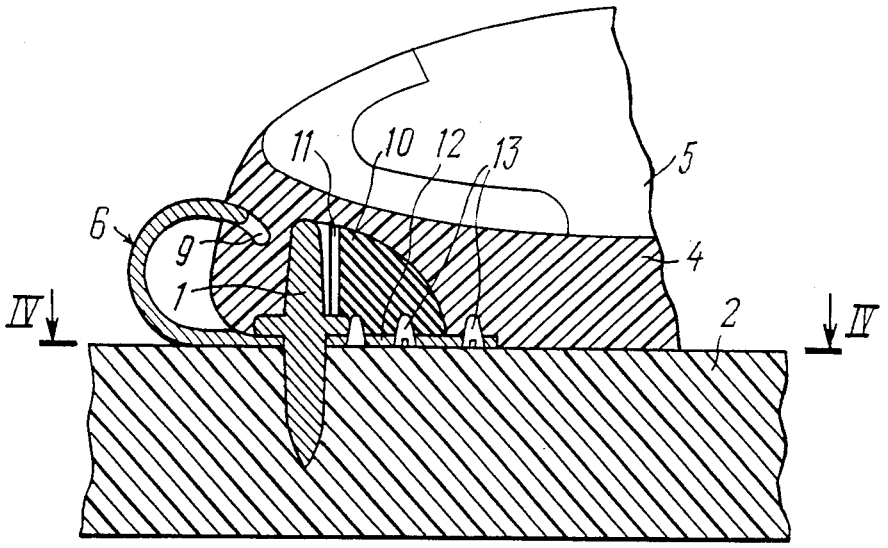
FIG. 3 is an embodiment of another ski binding (longitudinal section)
Figure 4:
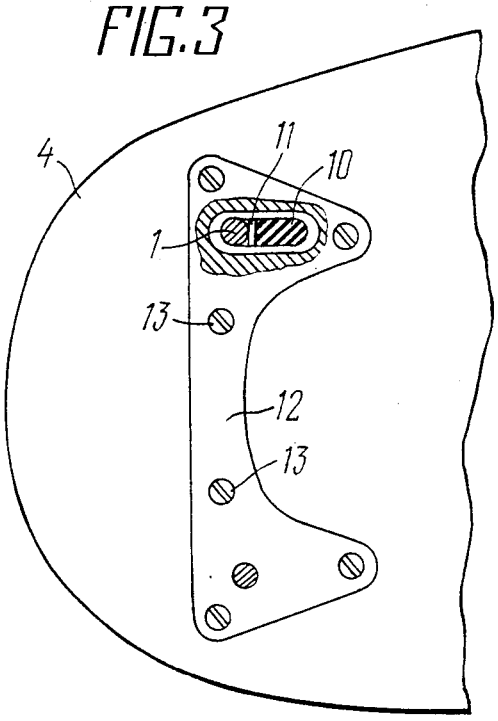
FIG. 4 represents a cross section IV—IV in FIG. 3.

According to another embodiment of the invention shown in FIGS. 3–4, a shock-absorber 10 of elastic material, e.g. rubber, is mounted in the expansion zone of the hole 3. A plate 11 is mounted between the shock-absorber 10 and the pin 1 acting as a contact between the pin 1 and the shock-absorber 10.

The shock-absorber 10 and the plate 11 are held in place in the holes 3 of the sole 4 by means of a plate 12 fixed to the sole 4 with fasteners 13.

The forward part of the sole 4 (FIG. 3) between the lock 6 and the rest pins 1 may be of elastic material, e.g. rubber. In this case lifting the boot 5 results in deformation of said part of the sole 4.

INDUSTRIAL APPLICABILITY

The invention may be used to the best advantage with sporting cross-country skis when the skier uses either classical or skating stride.

I claim:

1. In combination, a cross-country ski binding and a cross-country ski boot, said combination comprising:
   - at least one rest pin mounted on a ski and extending upwardly therefrom;
   - at least one rearwardly and downwardly arcuate passageway lin a toe portion of the sole of the boot, each passageway being open at the sole of the boot and adapted to receive one said rest pin and having a curvature corresponding to a trajectory of the sole when the heel of the boot rises upwardly as a skier pushes; and
   - lock means for retaining said at least one pin within said at least one passageway while permitting movement of said at least one passageway about an arcuate path relative to said at least one pin.

2. The combination according to claim 1; wherein each said rest pin includes an arcuate surface in contact with the toe portion of the sole of the boot in a respective arcuate passageway, said arcuate surface having a curvature corresponding substantially to a trajectory of the sole when the heel of the boot rises upwardly as a skier pushes.

3. In combination, a cross-country ski binding and a cross-country ski boot, said combination comprising:
   - at least one rest pin mounted on a ski and extending upwardly therefrom;
   - at least one downwardly open passageway in a toe portion of the sole of the boot, each passageway including an arcuate upper surface in sliding contact with a top portion of said at least one rest pin, said arcuate surface extending in a rearward direction from the top portion of the respective rest pin and corresponding to a trajectory of the sole when the heel of the boot rises upwardly as a skier pushes; and lock means for retaining said at least one pin within said at least one passageway while permitting movement of said at least one passageway about an arcuate path relative to said at least one pin.

4. The combination according to claim 3; wherein said passageway has an expansion zone to permit movement of at least one pin therein.

5. The combination according to claim 4; further including elastic shock absorber means mounted in the expansion zone of at least one said passageway.

* * * * *